US005499888A

United States Patent [19]

Hawkes

[11] Patent Number: 5,499,888

[45] Date of Patent: Mar. 19, 1996

[54] BIDIRECTIONAL ROADWAY FOR WHEELED VEHICLES

[76] Inventor: E. Gerry Hawkes, R.F.D. 1, Box 247, Wayside Rd., Woodstock, Vt. 05091

[21] Appl. No.: 413,167

[22] Filed: Mar. 29, 1995

[51] Int. Cl.[6] ..... E01C 11/24

[52] U.S. Cl. ..... 404/19; 404/42; 152/209 B

[58] Field of Search ..... 152/209 B, 209 D; 238/14; 404/17, 18, 19, 35, 36, 42, 27, 28

[56] References Cited

U.S. PATENT DOCUMENTS

| | | | |
|---|---|---|---|
| 2,975,977 | 3/1961 | Chodacki et al. | 238/14 |
| 3,547,175 | 12/1970 | Verdier | 152/209 B |
| 4,446,902 | 5/1984 | Madec et al. | 152/209 B |

*Primary Examiner*—Ramon S. Britts
*Assistant Examiner*—James A. Lisehora
*Attorney, Agent, or Firm*—Sughrue, Mion, Zinn, Macpeak & Seas

[57] ABSTRACT

A roadway for bicycle and other tired wheel vehicles formed of a plurality of end-to-end abutting tiles, preferably of a structural foam plastic such as polyethylene includes a generally rigid base having opposed top and bottom surfaces, with the top surface being flat and carrying integrally longitudinally and laterally spaced arcuate ridges. The arcuate ridges form alternating, laterally aligned rows of longitudinally spaced, oppositely facing arcuate ridges, with the arcuate ridges of a given row being offset laterally from corresponding arcuate ridges of adjacent longitudinally spaced rows by one half the length of an arcuate ridge. Further, the arcuate ridges of each lateral row are spaced from each other a distance such that the ends of the arcuate ridges of a given row lie within the concave curve of arcuate ridges of the adjacent, oppositely facing lateral row. As such, a bidirectional roadway is created, minimizing vehicle wheel vibration, permitting easy rolling of the vehicle wheels, while providing slip resistance to the vehicle wheels in all directions. Preferably, a narrow rib extends longitudinally of each arcuate ridge along the center thereof and drainage holes are preferably provided between the ends of the arcuate ridges of each row centered within the concave curve of the arcuate ridges of an adjacent facing row.

8 Claims, 1 Drawing Sheet

BIDIRECTIONAL ROADWAY FOR WHEELED VEHICLES

BACKGROUND OF THE INVENTION

This invention relates to bidirectional riding surface tiles or roadways for bicycles or like wheeled vehicles, and more particularly to such riding surfaces capable of providing durable, acceptably smooth, low-vibration traction for bicycles, wheelchairs, roller blades and other wheeled conveyances.

BACKGROUND OF THE INVENTION

This invention is an outgrowth of the development of a bicycle track which is the subject matter of my U.S. Pat. No. 5,152,632, issued Oct. 6, 1992 and entitled "SELF-GUIDANCE BICYCLE TRACK". Such bicycle transportation path was purposely designed to make bicycling, walking, jogging and wheelchair access easier along congested highways, over wetlands in parks, on the sides of bridges, along beaches and dunes, and in other difficult or sensitive locations. Such bicycle track transportation path or the like may be installed quickly without excavation or disturbance of natural and manmade environments. In the development of the patented bicycle track, it was determined that such transportation may be manufactured in strong light sections in the form of riding surface tiles which may be easily transported and installed. The present invention is directed to a new structural foam polyethylene (SFP) track incorporating recycled polyethylene plastic to form a high quality, low cost, low maintenance bicycle or like vehicle track.

Since the advent of the patented bicycle track, it has been determined that most raised patterns or open grating used for riding surfaces have a tendency to create wheel vibration and wobble which leads to instability to the bike and bike rider while smooth surfaces provide limited slip resistance both in the direction of travel and laterally thereto.

I have determined that such roadway or riding surface track, whether formed of end-to-end abutting tile sections, molded track sections, or of extended length sheet stock of extruded or otherwise molded plastic, requires upper surface texturing of specific design to minimize wheel vibration, allow easy rolling and provide slip resistance bidirectionally along the path of travel, as well as in directions at right angles thereto. It is therefore a primary object of the present invention to provide a bidirectional riding surface roadway for bicycles and other wheeled vehicles, in which the riding surface is applicable to vehicles moving in opposite directions along the longitudinal axis of the roadway, prevents wheel weaving during such movement, causes little vibration, is highly resistant to wear and abrasion, is textured in such a way as to prevent objects falling onto the top surface of the roadway from dropping between contoured surface projections, while having good flushing characteristics between the raised texture pattern for accumulated water and grit, which is relatively inexpensive and which may be molded recycled plastic.

While attempts have been made to formulate such improved roadway or wheeled vehicle riding surfaces, such attempts known to date have failed to meet the objects of the current invention.

U.S. Pat. No. 2,975,977 to Chodacki et al. issued Mar. 21, 1961 and entitled "TRACTION DEVICE FOR AUTOMOBILE TIRES" is directed to a inclined plane structure of wedge form adapted to be positioned in front of an automobile tire to assist in extraction of the automobile from snow or ice. The device is formed of metal as an inclined ramp and carries an upper traction surface which includes a plurality of arcuate ridges, all of which face in the same direction, generally in the direction of desired wheel travel up the inclined ramp as a series of longitudinally spaced in-line arcuate ridges in laterally spaced rows, with the arcuate ridges of adjacent rows being offset from each other, and with those arcuate ridges being laterally in-line to opposite sides of the median line within the longitudinal center of the ramp.

U.S. Pat. No. 3,616,111 issued Oct. 26, 1971 to Harry Raech, Jr. and entitled "PLASTIC LANDING PAD OF INTERCONNECTED PANELS" teaches a laminate structural landing pad for helicopters having top and bottom laminae of woven fiberglass, with the upper and lower surfaces of the panels being textured with matching recesses and protuberances respectively, the result of which is to permit interlocking of the panels when one panel is laid upon one another.

U.S. Pat. No. 4,035,536 issued Jul. 12, 1977 to Hadley F. Morrison and entitled "SANDWICH PANEL CORE" is directed to a panel core having a repetitive pattern forming surface ribbing comprised of triangles and hexagons where each side of a given hexagon is extended pinwheel fashion toward the appropriate side extensions of six adjoining hexagons.

U.S. Pat. No. 4,478,901 issued Oct. 23, 1984 to David R. Dickens et al. and entitled "FLOOR MAT CONSTRUCTION" teaches a floor mat constructed of a rubber-like material with an upper smooth surface and a bottom surface including barbell-like projections in a predetermined pattern about circular or hexagonal holes passing through the floor mat from top to bottom, with the projections extending from the lower surface providing a non-skid effect to the floor mat, and the holes permitting draining of water therethrough.

SUMMARY OF THE INVENTION

In accordance with the present invention, an improved roadway for bicycles and other preferably tired wheel vehicles is comprised of sheet stock material having a longitudinal or directional axis. The sheet stock material includes a generally rigid roadway base having front and rear edges and opposite sides, top and bottom generally flat surfaces, and integrally formed, alternating rows of spaced, laterally aligned, oppositely facing raised arcuate ridges. The rows extend generally perpendicular to the longitudinal axis and form a bidirectional riding surface. The integral alternate rows of spaced laterally aligned, oppositely facing raised arcuate ridges project from the top surface of the base. The arcuate ridges of one row are offset laterally from corresponding oppositely facing arcuate ridges of an adjacent row by one half the width of an arcuate ridge, and the arcuate ridges of each row being spaced from other a distance such that ends of the arcuate ridges lie within the curve of the oppositely facing arcuate ridge for adjacent rows, whereby the distance between the arcuate ridges is minimized while retaining good bidirectional traction, thus providing easy rolling, low-vibration traction for bicycles, wheelchairs, roller blades and other wheeled conveyances as well as a good walking surface for pedestrians. Preferably, the arcuate ridges include outwardly projecting narrow ridges on the upper face of the arcuate ridges, extending over the major length of the arcuate ridges. Preferably, drainage holes are formed within the base from the top surface to the bottom surface between the ends of laterally adjacent arcuate ridges of the same row and centered within concave side surfaces of the arcuate ridges of the facing adjacent row of arcuate ridges. Small diameter screw mounting holes may be provided within the base between the spaced ends of the arcuate ridges of a same row and to a side of the arcuate ridges opposite of the drainage holes.

BRIEF DESCRIPTION OF TEE DRAWINGS

DESCRIPTION OF THE PREFERRED EMBODIMENT

Figure 1:
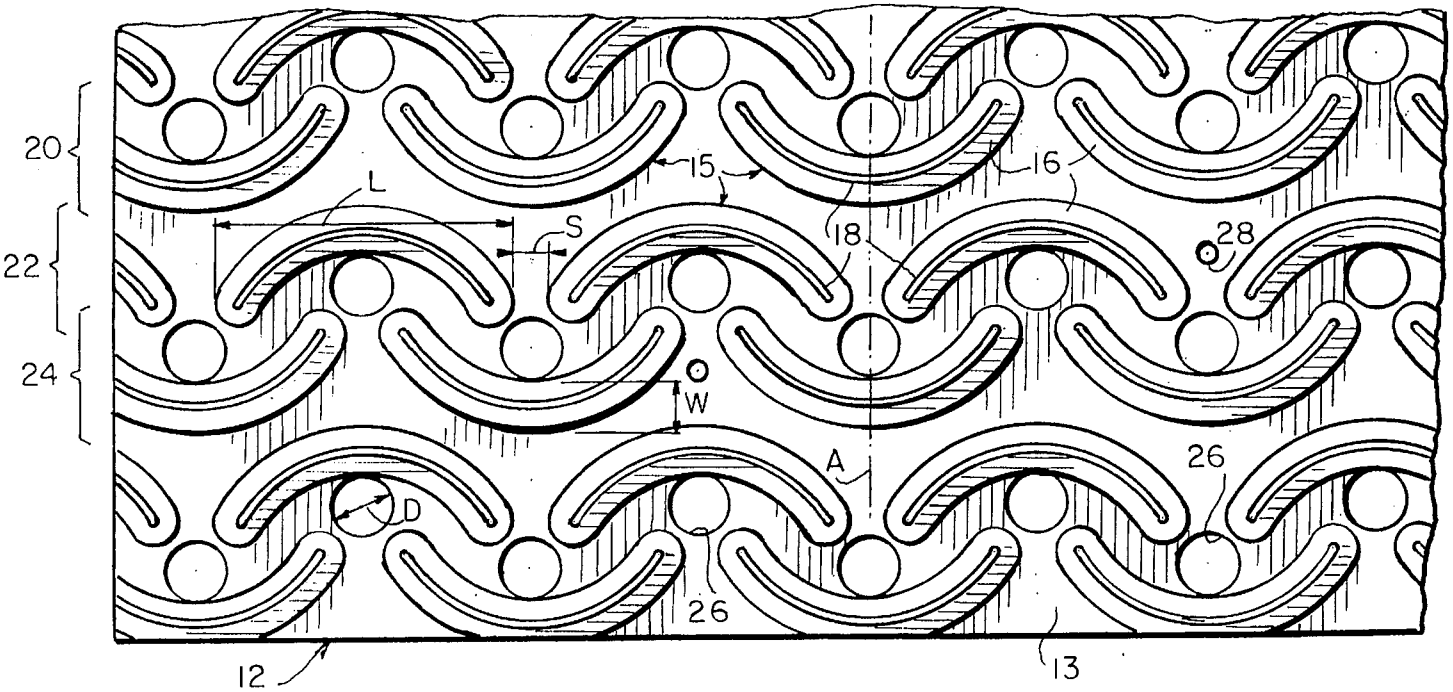
FIG. 1 is a top plan view of a bidirectional riding surface tile forming a preferred embodiment of the invention.
Figure 2:
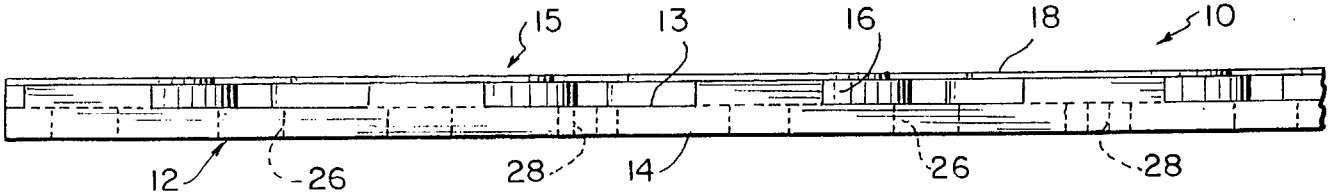
FIG. 2 is a front elevational view of the tile of FIG. 1.
Figure 3:
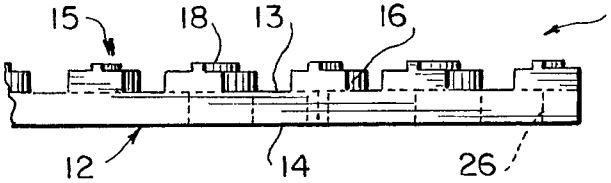
FIG. 3 is a side elevational view of the tile of FIGS. 1 and 2.

Reference is made to drawing FIGS. 1, 2 and 3, which illustrate a preferred embodiment of an improved roadway or riding surface tile indicated generally at 10 for bicycles and other preferably tired wheel vehicles. The tile indicated generally at 10 is constituted by sheet stock material which includes a generally rigid roadway base indicated generally at 12, having an opposed flat top surface 13 and a bottom surface 14 of a thickness in the example of approximately ¼ inch. Formed integrally and preferably molded with the base 12 are a plurality of upright, vertically projecting arcuate ridges 15 and having an overall length L which is considerably larger than the thickness or width W. Each arcuate ridge 15 has a body portion 16, from which rises a thin, narrow projection or rib at 18 which extends over the major length of the arcuate ridge, near one end, to near its opposite end. A series of end-to-end aligned, laterally spaced arcuate ridges 15 form individual rows as at 20, 22 and 24, FIG. 1, with the ends of the arcuate ridges 15 being spaced from each other a distance indicated at S, which in the illustrated embodiment is on the order of the thickness or width of the arcuate ridges. Purposely, the adjacent rows of arcuate ridges face opposite to each other and the alternate rows of oppositely facing arcuate ridges are offset laterally by half the length of an arcuate ridge. They are additionally spaced close enough so that the ends of the arcuate ridges lie within the curve of the oppositely facing arcuate ridge. This arrangement provides advantageous effects and properties to the roadway tiles 10, which are highly important to the movement of bicycles, wheelchairs, roller blades and other like wheeled conveyances. Further, the arrangement enhances the bidirectional movement of wheeled traffic over the top surface 13 of the tiles. The tiles may be arranged end-to-end and may be interlocked to each other. They are preferably fixedly mounted to an underlying planar support surface by screwing or nailing of the same via screws or nails (not shown) through small diameter nail holes 28, FIG. 1. Wheel weaving, which is common in many open grate or knob type traction surfaces, particularly noticeable when automobiles pass over open metal grate floors of bridges or the like, is eliminated in a roadway formed of an elongated sheet stock material member having the surface configuration described above on the top surface 13 of that member, or a roadway created by a series of multiple end abutting tiles 10. Due to the existence of the oppositely facing, laterally offset position of the arcuate ridges 15 for instance of row 20 relative to row 22, if any thin, straight edge object falls on or is laid on the top surface 13 of tile 10, irrespective of its position or rotation, it is impossible for it to drop between the arcuate ridges 15, unless it is of short length, which then is immaterial. Such feature is important when shoveling snow from the surface or dragging objects across the top surface 13 of the tile 10 or a roadway constructed of multiple tiles in end abutting position. The multiple row, oppositely facing, adjacent arcuate ridge pattern is the same when viewed from the front or the rear, evidencing the control and prevention of wheel weaving while providing excellent traction due to the narrow spacing between the ends of the arcuate ridges for each row. The thin, narrow ribs 18 projecting upwardly and centered on the arcuate ridges 15 relative to the width or thickness of such arcuate ridges act to provide an additional frictional bite or grip to the wheels of the vehicles engaging those arcuate ridges during traversing of the roadway bidirectionally along the longitudinal axis A of tile 10, over the extent of the path defined by that member or a series of end-to-end abutting members. It should be apparent that while the invention is illustrated as using relatively shallow arcuate ridges 15, such integral top surface ridges may be broadly V-shaped or U-shaped to serve the same function, with the V's or U's substituting for the shallow arcuate ridges for adjacent rows facing each other and being spaced similarly such that the opposed ends of laterally adjacent arcuate ridges, V's or U's face the concave, oppositely facing and laterally offset arcuate ridges, V's or U's by a distance of one half the length of such member.

Extended length molded bicycle track path and ramp systems may incorporate the same textured top surface roadway formed of molded sections or sheet stock similar to the relatively short length tiles 10 of the illustrated embodiment. Such content will operate equally as well in flat or slightly concave, snap together panels to create varying traction surfaces which may be self-supporting or simply fixedly mounted to an underlying support surface such as a wooden floor, steel open frame, etc.

Preferably, the tiles 10 or their equivalent are provided with a series of spaced drain holes 26 which are located purposely at positions which are between the ends of adjacent arcuate ridges 15 and centered with the oppositely facing arcuate ridges of the adjacent lateral row, thus centered within the concave side face of the oppositely facing arcuate ridge, whose arcuate ridges are laterally offset by one half the length of the arcuate ridge. Indeed, the oppositely facing concave surfaces of the arcuate ridges of adjacent rows tend to direct the flow of water tending to accumulate on the top surface 13 of the tile towards the drain holes 26 for passage therethrough to maintain the tread surface of the tile 10 free of accumulated water. Small diameter screw holes 28 allow screws or like fasteners to fixedly mount the tiles to an underlying support surface (not shown). Thus, braking and bike control is generally superior to normal concrete or macadam pavement conditions since the presence of the drain holes and the directional capabilities of the arcuate ridges ensure that no fine grit and sand build up on the tile top surface 13 to act like miniature ball bearings. Further, the structure eliminates any frost heaves, puddles or potholes common to most roadways. The users of the bicycles, wheelchairs, roller blades, etc. find the ride to be comfortable, smooth and easy. While the tiles 10 or the longer length sheet stock material components of the improved roadway are preferably formed of structural foam polyethylene (SFP), and particularly incorporating recycled polyethylene plastic, it is envisioned that such molded plastic components such as tile 10 may include a filler material such as ground walnut shells, pecan shells, rubber granulates, etc.

From the above, it is apparent that the improved roadway incorporates principal features, including the use of recycled plastic; drainage holes paired with arcuate ridges to enhance the flushing of water and grit; interlocking arcuate ridges which allow an open design yet leave a small gap for wheels to bridge, ensuring a smooth ride; oppositely directed arcuate ridges laterally aligned but offset by one half the length of the arcuate ridges to provide primary resistance to slipping in the direction of travel bidirectionally, while also providing excellent resistance to side slippage; interlocking arcuate ridges which promote straight tracking of wheels and prevention of wheel wandering; raised ridges on the upper surface of each arcuate ridge body to increase traction and reduce the effects of any ice buildup in adverse weather; molded in screw holes in the tiles or equivalent sheet stock for secure attachment; slight arch in the tiles to ensure that the leading edge stays down when the middle of the tile is fastened; sufficient rigidity to allow bridging of gaps with sufficient flexibility to conform to underlying support surface irregularities; and ability to readily sever the tile via standard woodworking tools for easy mounting and placement of the improved roadway tile or sheet stock on an underlying support surface.

While the exemplary embodiment of the invention has been described above in detail and shown in the accompanying drawings, it is to be understood that such embodiment is merely illustrative of and not restrictive relative to the broad invention, and I do not desire to be limited in my invention to the specific construction or arrangement shown and described since various other obvious modifications may occur to persons having ordinary skill in the art.

What is claimed is:

1. In a roadway for bicycle and other tired wheel vehicles comprising a molded modular, self-supporting track extending longitudinally in the direction of vehicle travel and including a generally rigid roadway base having opposed top and bottom surfaces, a plurality of transversely arranged, arcuate ridges carried by said base and projecting upwardly therefrom above said top surface for engagement with a tire tread, individual arcuate ridges being spaced from each other longitudinally and laterally, the improvement wherein;

said arcuate ridges form alternating lateral rows of longitudinally spaced, oppositely facing arcuate ridges, said arcuate ridges of a given row being offset laterally from corresponding arcuate ridges of adjacent longitudinally spaced rows by one half the length of an arcuate ridge, and said arcuate ridges of each lateral row being spaced from each other a distance such that the ends of the arcuate ridges of a given row lie within the concave curve of the arcuate ridges of an adjacent, oppositely facing lateral row, whereby;

a pattern of interlocking traction arcuate ridges minimize vehicle wheel vibration, allow easy rolling of the vehicle and provide slip resistance to the vehicle wheels in all directions, while facilitating bidirectional travel of the vehicles longitudinally over the roadway.

2. The roadway as claimed in claim 1, further comprising narrow centerline ribs projecting outwardly of tops of said arcuate ridges and extending longitudinally of said arcuate ridges over at least a major portion of each arcuate ridge to facilitate slip resistance to the vehicle wheels in all directions during movement of the vehicle longitudinally of the sheet stock material roadway.

3. The roadway as claimed in claim 2, further comprising drainage holes extending through said base from said top surface to said bottom surface and being positioned between the ends of adjacent arcuate ridges of each row and centered within concave curves of said arcuate ridges of the adjacent oppositely facing row of arcuate ridges.

4. The roadway as claimed in claim 1, further comprising drainage holes extending through said base from said top surface to said bottom surface and being positioned between the ends of adjacent arcuate ridges of each row and centered within concave curves of said arcuate ridges of the adjacent oppositely facing row of arcuate ridges.

5. The roadway as claimed in claim 1, further comprising small diameter fastener mounting holes within said roadway base from said top surface to said bottom surface and being positioned intermediate of said arcuate ridges of adjacent rows for facilitating fixing of said base to an underlying support member.

6. The roadway as claimed in claim 1, wherein said track material comprises a molded structural foam plastic base and integral arcuate ridges.

7. The roadway as claimed in claim 6, wherein said structural foam plastic base comprises structural foam polyethylene (SFP).

8. The roadway as claimed in claim 7, wherein said structural foam plastic base comprises recycled polyethylene plastic.

* * * * *